US006422211B1

(12) United States Patent
Boecking

(10) Patent No.: US 6,422,211 B1
(45) Date of Patent: Jul. 23, 2002

(54) FUEL INJECTION DEVICE FOR INTERNAL COMBUSTION ENGINES

(75) Inventor: Friedrich Boecking, Stuttgart (DE)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 09/623,106

(22) PCT Filed: Nov. 24, 1999

(86) PCT No.: PCT/DE99/03721

§ 371 (c)(1),
(2), (4) Date: Dec. 26, 2000

(87) PCT Pub. No.: WO00/39451

PCT Pub. Date: Jul. 6, 2000

(30) Foreign Application Priority Data

Dec. 29, 1998 (DE) ..... 198 60 678

(51) Int. Cl.[7] ..... F02M 37/04
(52) U.S. Cl. ..... 123/501; 123/458; 123/300
(58) Field of Search ..... 123/458, 299, 123/300, 498, 446, 467, 501

(56) References Cited

U.S. PATENT DOCUMENTS 3,919,989 A * 11/1975 Jarrett et al. ..... 123/447
4,175,587 A * 11/1979 Chadwick et al. ..... 137/625.65
4,745,898 A * 5/1988 Egler et al. ..... 123/300
5,497,750 A * 3/1996 Mueller et al. ..... 123/467
5,893,350 A * 4/1999 Timms ..... 123/467
5,915,361 A * 6/1999 Heinz et al. ..... 123/458
5,941,215 A * 8/1999 Augustin ..... 123/467
6,021,760 A * 2/2000 Boecking ..... 123/467
6,067,955 A * 5/2000 Boecking ..... 123/299

* cited by examiner

*Primary Examiner*—Carl S. Miller

(57) ABSTRACT

A fuel injection device for internal combustion engines which supplies fuel from a high-pressure fuel source to a fuel injection valve, controlled by means of a control device. The fuel injection valve has an injection valve member which is acted on with the supplied high fuel pressure by means of a pressure shoulder and can consequently be opened in order to execute the injection. The fuel is supplied via a pressure line whose flow is controlled by a control valve whose control valve member is moved between first and second valve seats in a valve chamber and thereby controls the connection between the high-pressure fuel source and the fuel injection valve via the valve chamber for a preinjection and a main injection.

10 Claims, 2 Drawing Sheets

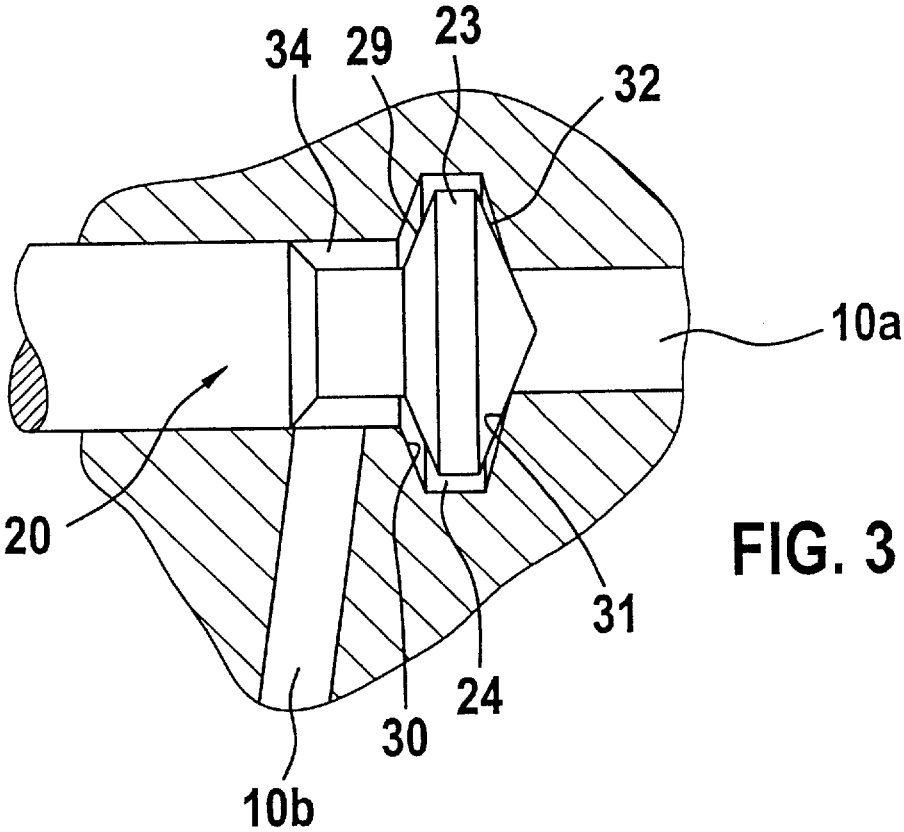
FIG. 3
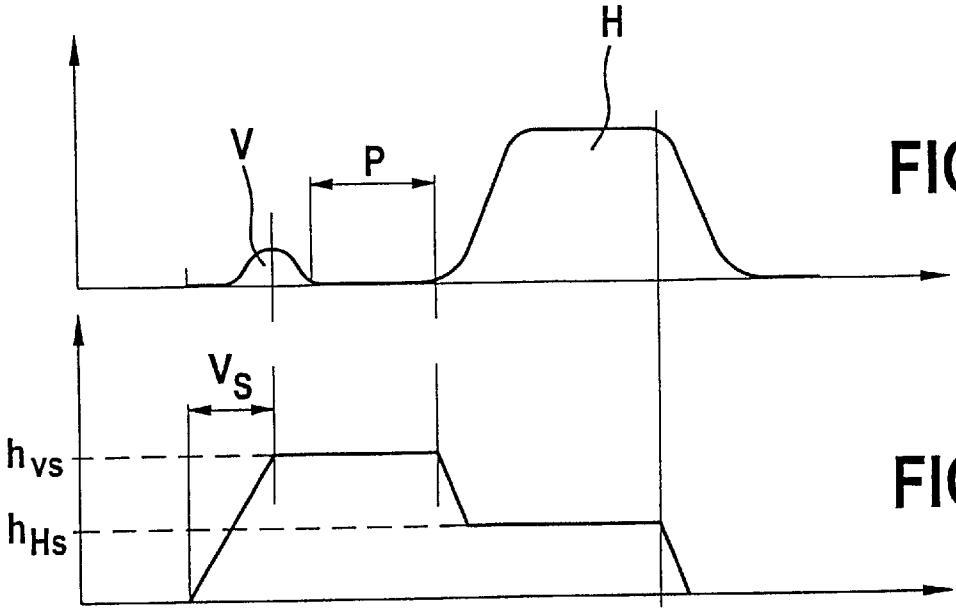
FIG. 2a
FIG. 2b

FUEL INJECTION DEVICE FOR INTERNAL COMBUSTION ENGINES

PRIOR ATR

The invention is based on a fuel injection device for internal combustion engines. In a fuel injection device of this kind, which has been disclosed by DE 196 24 001 A1, the fuel injection valve member, which is supplied by a high-pressure fuel source, is controlled by means of various hydraulic forces that act on the fuel injection valve member opening and closing direction. The fuel injection valve member has an injection valve member for controlling an injection opening and, at an end remote from the injection opening, encloses a control chamber, which is supplied with high fuel pressure from a high-pressure fuel source by means of a throttled supply conduit. The control chamber can be relieved of pressure by means of the control valve that is actuated by a piezoelectric actuator so that in this instance, by means of the hydraulic pressure acting on the pressure shoulder of the injection valve member and with the lack of hydraulic high-pressure in the control chamber, the injection valve member is opened. In contrast, when the control chamber is closed, the high fuel pressure is built up again in the control chamber and the injection valve member is brought back into the closed position. In the known fuel injection device, the control valve is disposed in an outlet conduit of the control chamber. In addition to the connection from the high-pressure reservoir to the control chamber, in the known fuel injection device, another connection to the pressure chamber must be produced. The chamber is defined by the pressure shoulder of the injection valve member and is continuously kept at a high pressure. This known device is costly for the reason described since in addition to the multiple connection from the high-pressure fuel source to the control chamber and to the pressure chamber, the inlet and outlet cross sections to the control chamber and the pressure-impinged surfaces on the injection valve member must also be matched to one another exactly.

ADVANTAGES OF THE INVENTION

The fuel injection device has an advantage that through the use of simple means, the injection valve member of the fuel injection valve can be rapidly and precisely opened by the piezoelectric drive mechanism for a preinjection and is then closed again in order to be subsequently opened for the ensuing main injection. In this connection, it is significantly advantageous that the control valve member only has to be moved back and forth once for the entire procedure. In particular, with continuous equiaxial movement of the control valve member, the short phase of the opening of both valve seats in the control valve permits the achievement of very short high-pressure supply times in order to produce a preinjection.

In a particularly advantageous manner despite smaller working strokes of a piezoelectric actuator, large opening strokes of the control valve member can be achieved by means of a hydraulic transmission. Another advantageous embodiment of the invention is comprised in that, the high fuel pressure, which comes from the high-pressure fuel source and prevails against the control valve member when the control valve member is closed, produces a force compensation on the control valve member since equivalent surfaces are the same size in both movement directions of the control valve member. According to the inventor, the surface area ratio of surfaces subjected to the pressure acting on the control valve member is selected so that the high pressure of the high-pressure fuel source prevailing in the recess loads the control valve member slightly more in the opening direction than in the closing direction. The closing takes place as a result of restoring spring forces on the control valve member.

Finally in a last embodiment, the pressure impingement of he control valve member is selected so that the inlet of the pressure line to the valve chamber takes place coaxial to the valve tappet so that when the valve head is resting against a second valve seat, the connection from the high-pressure fuel source to the valve chamber or to the pressure chamber of the fuel injection valve is closed. In this connection, the control valve member is in fact acted on by relatively high opening forces, but the valve tappet bore is only acted on by low-pressure fuel so that the leakage losses of the control valve are low. The pressure impingement on the valve tappet or the valve tappet bore that guides the valve tappet takes place only during the connection of the pressure line to the pressure chamber, i.e. during the injection phase of the fuel injection device.

BRIEF DESCRIPTION OF THE DRAWINGS

Two exemplary embodiments of the invention are shown in the drawings and will be described in detail in the description that follows.

FIGS. 2*a* and 2*b* depict the stroke progressions of the fuel injection valve and control valve member of the exemplary embodiment according to FIG. 1, and FIG. 3 shows a modification of the exemplary embodiment according to FIG. 1, with reversed connections of the pressure line, which leads from the high-pressure fuel reservoir to the fuel injection valve.

DESCRIPTION OF THE EXEMPLARY EMBODIMENTS

Figure 1:
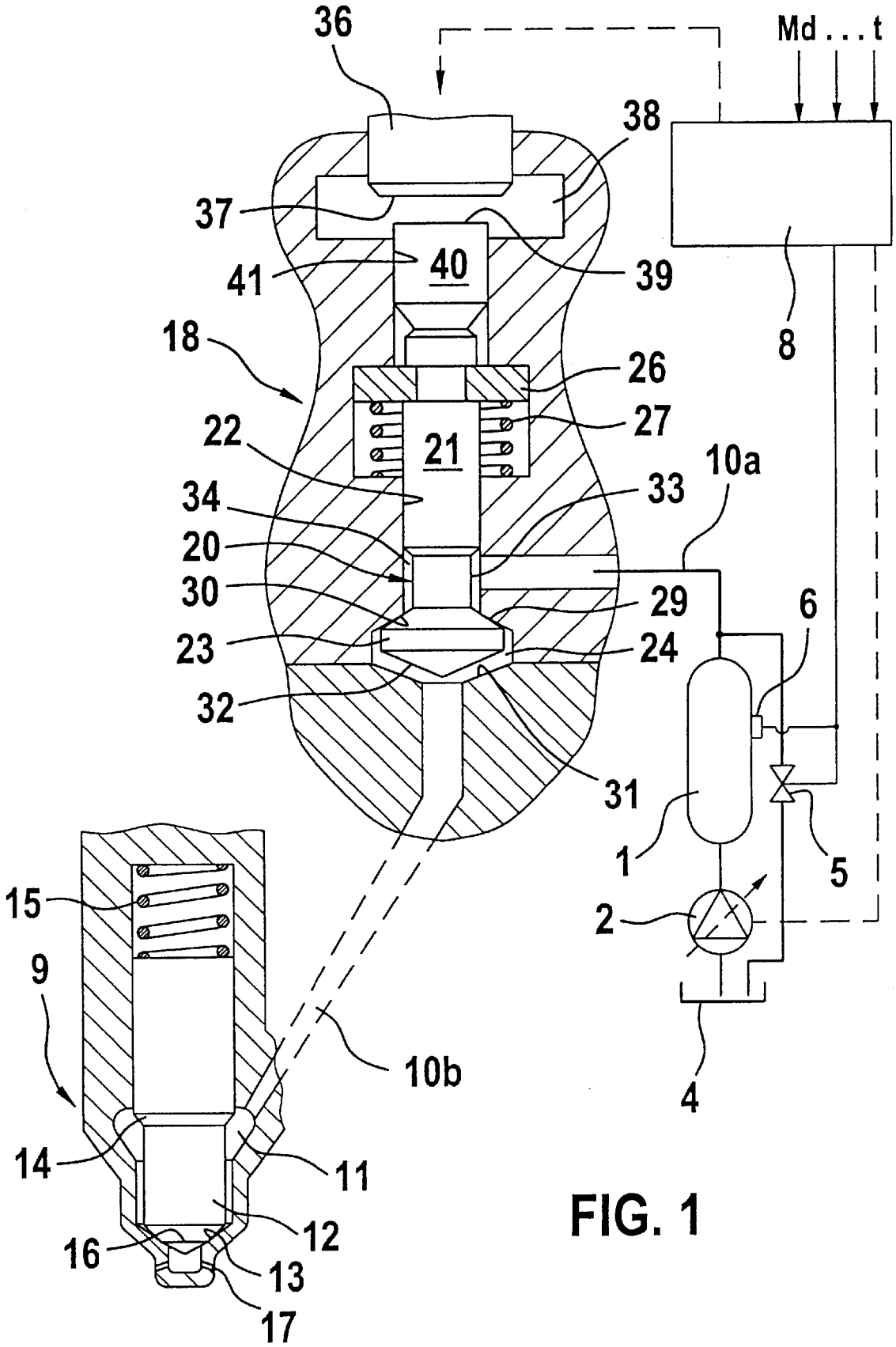
FIG. 1 is a schematic depiction of a first exemplary embodiment of a fuel injection device with a fuel supply from a high-pressure fuel reservoir and a fuel injection valve.

A fuel injection device, which permits a large variation of the fuel injection with regard to injection quantity and injection time at high injection pressures but at a low cost, is realized by means of a so-called common rail system. This provides a different type of high-pressure fuel source for use in a fuel injection than is standard in conventional high-pressure fuel injection pumps.

In the common rail injection system shown in FIG. 1, a high-pressure fuel reservoir 1 is provided as a high-pressure fuel source and is supplied with fuel, which is brought to injection pressure, from a fuel tank 4 by a high-pressure delivery pump 2. The pressure in the high-pressure fuel reservoir is detected by a pressure sensor 6 and is supplied as a signal to an electric control device 8, which controls the pressure in the high-pressure fuel reservoir via a pressure control valve 5. The control device also controls the opening and closing of fuel injection valves 9, which are supplied with fuel for the injection from the high-pressure fuel reservoir.

To this end, a pressure line with the partial branches 10*a*, 10*b* leads from the high-pressure fuel reservoir 1 to a pressure chamber 11 in the fuel injection valve. The pressure chamber 11 encompasses the end of the fuel injection valve member 12 in an annular fashion and extends to a valve seat 13. In the vicinity of the pressure chamber 11, the injection valve member has a pressure shoulder 14 which is loaded by the pressure of the pressure chamber 11 in the opening direction of the injection valve member 12 counter to a closing spring 15 that engages the back side of the injection valve member. If the hydraulic forces on the pressure shoulder 14 exceed the closing forces of the closing spring 15, then the valve member lifts its sealing surface 16 up from the valve seat 13 and produces the connection between the pressure chamber 11 and injection openings 17 so that the fuel injection can occur.

This fuel injection is controlled by the supply of high fuel pressure to the pressure chamber 11 via the pressure line 10*a*, 10*b*. A control valve 18 is provided in this pressure line in order to control the pressure. This control valve 18 has a control valve member 20 with a valve tappet 21. The valve tappet is guided in a valve tappet bore 22 and has a valve head 23 on an end. The valve tappet can be moved inside a valve chamber 24. At an end remote from the valve head 23, the tappet 24 has a spring plate 26; a closing spring 27 is clamped between this spring plate 26 and the housing and attempts to move the valve head, with a valve head sealing face 29 on one side, into contact with a correspondingly conically embodied first valve seat 30. The first valve seat 30 is situated at the transition between the wider diameter valve chamber 24 and the tappet bore 22.

On the end of the valve chamber 24 disposed opposite the first valve seat 30, there is a second, likewise conical valve seat 31 at the outlet of the part 10*b* of the pressure line from the valve chamber 24. The pressure line part 10*b* leads to the pressure chamber 11. This second valve seat 31 cooperates with a second valve head sealing face 32 on the valve head 37 so that the connection between the valve chamber 24 and the pressure line 10*b* is closed when the control valve member 20 is moved from the first valve seat to the second valve seat 31 counter to the force of the closing spring 27.

Adjacent to the first valve head sealing face 29, the tappet 21 has an annular recess 33 which, when the valve head 23 is resting against the first valve seat 30, encloses an annular chamber 34 together with the tappet bore 22. The pressure line part 10*a* that comes from the high-pressure fuel reservoir 1 feeds into this annular chamber 34. If the control valve member 20 is in the closed position shown in FIG. 1, then the connection between the high-pressure fuel reservoir 1 and the pressure chamber 11 is closed. The forces acting on the control valve member 20 due to the impingement of high pressure of the annular chamber 34 are essentially compensated for in the axial direction of the control valve member. Through a corresponding embodiment of the first valve seat 30 and first valve head sealing face 29, the pressure-impinged surface area on the control valve member 20 pointing in the direction of the valve chamber 24 can be slightly greater than the surface area on the tappet acting in the direction of the spring plate 26. The closing spring 27 exerts the necessary force for reliably closing the control valve 18, which is greater than the resulting hydraulic force acting in the opening direction. This has the advantage that small actuating forces are required for the control valve member 20.

The control valve member 20 is actuated by means of a piezoelectric actuator whose actuator 36 is partially depicted in FIG. 1. With its end 37, the actuator 36 adjoins part of a closed transmission chamber 38, which is also adjoined by an end 39 of a tappet actuating piston 40 which is guided in a sealed fashion in a guide bore 41 that coaxially adjoins the valve tappet bore 22. The end 37 of the actuator 36 is thereby significantly larger than the end 39 of the tappet actuating piston 40. If the piezoelectric actuator is excited by the control device 8 and the actuator 36 is moved into the transmission chamber 38, then the small stroke of the actuator 36 is increased by the surface area ratio of the ends 37 and 39 to a greater stroke of the tappet actuating piston 40 which, resting correspondingly against the end of the valve tappet 21, moves the control valve member 20 to a relatively large opening stroke.

The movements of the control valve member 20 and the injection valve member 12 are depicted one above the other in FIG. 2*a* and FIG. 2*b*. In order to carry out a preinjection, the piezoelectric element is excited so that the valve head lifts up from its contact against the first valve seat 30 until the valve head comes into contact with the second valve seat 31. This movement connects the two partial lines 10*a* and 10*b* of the pressure line to each other via the valve chamber 24 so that high fuel pressure can travel into the pressure chamber 11 and produces a lifting of the injection valve member 12 there. This is shown with the stroke V in FIG. 2*a*. The corresponding stroke of the control valve member is shown over the region $V_s$ in FIG. 2*b*. At the end of this stroke, which is labeled with $h_{vs}$ in the graph, the connection between the pressure line parts 10*a* and 10*b* of the pressure line is interrupted again, which leads to the drop in the injection V according to FIG. 2*a*. After an injection pause P, the control valve member 20 is then moved back through corresponding control of the piezoelectric actuator in such a way that the valve head 23 assumes a stroke $h_{Hs}$ in which the valve head is spaced apart from both the first valve seat 30 and the second valve seat 31 and consequently has produced the connection of the partial lines 10*a* and 10*b* of the pressure line. The main injection H then occurs for the duration of time that the control valve member remains in this position. Finally, in order to end the main injection, the control valve member 20 is moved completely back again so that the first valve head sealing face 29 in turn comes into sealed contact with the first valve seat 30.

In this embodiment of the control valve member, only small switching forces are required for the control valve member 20 since, with high-pressure impingement, it is essentially force-compensated between injections in the initial position shown in FIG. 1. However, the high fuel pressure contacts the valve tappet 21 so that leakage losses can occur along the valve tappet bore 22. Care must be taken that an appropriate discharge takes place.

In FIG. 3, the control valve is used in essentially the same type of embodiment as in FIG. 1. The only thing different here is that the pressure line does not feed into the annular chamber 34 with its pressure line part 10*a*, but feeds into the valve chamber 24 at the second valve seat. The pressure line part 10*b* of the pressure line then points away from the annular chamber 34. The control of the control valve can take place in the same manner as in the first exemplary embodiment. In the initial position, the valve head 23 rests with its first valve head sealing face 29 against the first valve seat 30 so that the valve chamber 24 is subjected to the high pressure supplied by the pressure line 10*a*. This pressure holds the valve closing member 20 in the closed position. If a preinjection is to take place, then the control valve member 20 is moved, as before, away from the first valve seat 30 toward the second valve seat 31 and the connection is temporarily produced between the pressure line parts 10*l* and 10*b* for a time that is sufficient for triggering a preinjection V according to FIG. 2*a*. When the valve head 23 comes back into contact with the second valve seat 31, this preinjection is then ended and after a pause P, the control valve 20 is brought, as before, into an intermediary position between the two valve seats 20 and 21 in order to carry out the main injection H. Then, this returning motion is continued until the valve head 23 once more rests against the first valve seat 30 and ends the main injection.

In this embodiment, the leakage quantity along the valve tappet 21 is reduced since this is only acted on by the high pressure during the injection phases. However, greater actuation forces of the control valve member are required, which can be simply produced, though, by means of a piezoelectric actuator with a hydraulic transmission. The hydraulic transmission thereby advantageously permits the large opening strokes $h_{vs}$.

The foregoing relates to a preferred exemplary embodiments of the invention, it being understood that other variants and embodiments thereof are possible within the spirit and scope of the invention, the latter being defined by the appended claims.

I claim:

1. A fuel injection device for internal combustion engines, comprising a high-pressure fuel source (1), from which fuel is supplied via a pressure line (10*a*, 10*b*) to a fuel injection valve (9) in order to control an injection opening (17), the fuel injection valve (9) has an injection valve member (12) with a pressure shoulder (14) that defines a pressure chamber and is loaded by a pressure of the fuel supplied via the pressure line (10*a*, 10*b*), by the pressure, the injection valve member (12) is lifted up from an injection valve seat (13) counter to a restoring force (15) in order to open the injection valve (17), and a control valve (18), which controls a movement of the injection valve member (12) and has a control valve member (20) that is actuated by a piezoelectric actuator (36), a valve tappet (21) which is guided in a housing and on one end, is provided with a valve head (23), which protrudes into a valve chamber (24) and is provided with two opposing valve head sealing faces (29, 32), with the valve head sealing faces (29, 32), the valve head sealing faces respectively cooperate with one of first and second valve seats (30, 31) of the control valve and thereby controls the flow of fuel in the pressure line (10*a*, 10*b*), which leads from the high-pressure fuel source and feeds into the valve chamber (24) via the first valve seat (30) and leaves the valve chamber (24) via the second valve seat (31) of these valve seats, in which the control valve member (20) is actuated by the piezoelectric actuator (36) so that the control valve member is moved with the valve head (23) moved from one of the first and second valve seats or remains in an intermediary position between the first and second valve seats, in which position the first and second line parts (10*a*, 10*b*) leading from the high-pressure fuel source are connected to each other via the valve chamber (24), in order to control the movement of the injection valve member (12), the control valve (20) is disposed in the pressure line (10*a*, 10*b*) leading to the pressure chamber (11) defined by the pressure shoulder (14).

2. The fuel injection device according to claim 1, in which the control valve member (20) is actuated by the piezoelectric actuator (36) by means of a hydraulic transmission (37, 38, 39).

3. The fuel injection device according to claim 1, in which the valve head (23) has two conically embodied valve head sealing faces (29, 32), which cooperate with conical valve seats (30, 31), and adjacent to the valve head sealing face (29), the valve tappet (21) has a recess (33) which, together with a valve tappet bore (22) ending at the first valve seat, constitutes an annular chamber (34), which is continuously connected to the pressure line (10*a*) leading to the high-pressure fuel source (1), and the pressure line (10*b*) leads from the second valve seat (31) back to the prefigure chamber (11).

4. The fuel injection device according to claim 2, in which the valve head (23) has two conically embodied valve head sealing faces (29, 32), which cooperate with conical valve goats (30, 31), and adjacent to the valve head sealing face (29), the valve tappet (21) has a recess (33) which, together with a valve tappet bore (22) ending at the first valve seat, constitutes an annular chamber (34), which is continuously connected to the pressure line (10*a*) leading to the high-pressure fuel source (1), and the pressure line (10*b*) leads from the second valve seat (31) back to the pressure chamber (11).

5. The fuel injection device according to claim 3, in which the pressure-impinged surface area pointing toward the valve chamber is greater than in an opposite pressure-impinged surface area pointing toward the tappet.

6. The fuel injection device according to claim 4, in which the pressure-impinged surface area pointing toward the valve chamber is greater than in an opposite pressure-impinged surface area pointing toward the tappet.

7. The fuel injection device according to claim 1, in which the valve head (23) has first and second conically embodied valve head sealing faces (29, 32), which cooperate with conical valve seats (30, 31), and adjacent to the valve head sealing face (29), the valve tappet (21) has a recess (33) which, together with a valve tappet bore (22) ending at the first valve seat (30), constitutes an annular chamber (34) which is continuously connected to the pressure line (10*b*) leading to the pressure chamber (11), and the pressure line (10*a*) leading from the high-pressure fuel source (1) feeds into the valve chamber (24) via the second valve seat (31).

8. The fuel injection device according to claim 2, in which the valve head (23) has first and second conically embodied valve head sealing faces (29, 32), which cooperate with conical valve seats (30, 31), and adjacent to the valve head sealing face (29), the valve tappet (21) has a recess (33) which, together with a valve tappet bore (22) ending at the first valve seat (30), constitutes an annular chamber (34) which is continuously connected to the pressure line (10*b*) leading to the pressure chamber (11), and the pressure line (10*a*) leading from the high-pressure fuel source (1) feeds into the valve chamber (24) via the second valve seat (31).

9. The fuel injection device according to claim 3, in which the valve head (23) has first and second conically embodied valve head sealing faces (29, 32), which cooperate with conical valve seats (30, 31), and adjacent to the valve head sealing face (29), the valve tappet (21) has a recess (33) which, together with a valve tappet bore (22) ending at the first valve seat (30), constitutes an annular chamber (34) which is continuously connected to the pressure line (10*b*) leading to the pressure chamber (11), and the pressure line (10*a*) leading from the high-pressure fuel source (1) feeds into the valve chamber (24) via the second valve seat (31).

10. The fuel injection device according to claim 4, in which the valve head (23) has first and second conically embodied valve head sealing faces (29, 32), which cooperate with conical valve seats (30, 31), and adjacent to the valve head sealing face (29), the valve tappet (21) has a recess (33) which, together with a valve tappet bore (22) ending at the first valve seat (30), constitutes an annular chamber (34) which is continuously connected to the pressure line (10*b*) leading to the pressure chamber (11), and the pressure line (10*a*) leading from the high-pressure fuel source (1) feeds into the valve chamber (24) via the second valve seat (31).

* * * * *